US006717134B2

(12) United States Patent
Bowdler

(10) Patent No.: US 6,717,134 B2
(45) Date of Patent: Apr. 6, 2004

(54) CALIBRATION METHOD

(75) Inventor: Andrew R. Bowdler, Walsall (GB)

(73) Assignee: Kratos Analytical Limited, Manchester (GB)

( * ) Notice: Subject to any disclaimer, the term of this patent is extended or adjusted under 35 U.S.C. 154(b) by 139 days.

(21) Appl. No.: 09/946,838

(22) Filed: Sep. 6, 2001

(65) Prior Publication Data

US 2002/0033447 A1 Mar. 21, 2002

(30) Foreign Application Priority Data

Sep. 6, 2000 (GB) ..... 0021901

(51) Int. Cl.[7] ..... H01J 49/36
(52) U.S. Cl. ..... 250/287; 250/282
(58) Field of Search ..... 250/287, 282, 250/252.1, 288

(56) References Cited

U.S. PATENT DOCUMENTS 5,821,534 A * 10/1998 Park ..... 250/287
6,188,064 B1 * 2/2001 Koster ..... 250/282
6,300,627 B1 * 10/2001 Koster et al. ..... 250/287

OTHER PUBLICATIONS

Vlasak et al, "Method for the Design of Broad Energy Range Focusing Reflectrons", Journal of the American Society for Mass Spectrometry, Elsevier Science Inc., US, vol. 7, No. 10, Oct. 1, 1996, pp1002–1008.

Breen et al, Automatic Poisson Peak Harvesting for High Throughput Protein Identification, Electrophoresis, Weinheim, Germany, vol. 21, Jun. 2000, pp. 2243–2251.

Juhasz et al, "The Utility of Nonspecific Proteases in the Characterization of glycoproteins by high–resolution time–of–flight mass spectrometry", International Journal of Mass Spectrometry and Ion Processes, Elsevier Scientific Publishing Co., Amsterdam, NL, vol. 169–170, Dec. 1, 1997, pp 217–230.

* cited by examiner

*Primary Examiner*—John R. Lee
*Assistant Examiner*—Christopher M. Kalivoda
(74) *Attorney, Agent, or Firm*—Squire, Sanders & Dempsey L.L.P.

(57) ABSTRACT

In its most general terms the invention compensates for the effect of the mass offset in the prior art calibration method. This can be achieved either by correcting for the offset or assigning mass to the peaks in such a way that the offset is avoided. Accordingly in a first aspect there is provided a method of calibrating a reflectron time-of-flight mass spectrometer using a spectrum generated by fragment ions wherein the mass of the fragment ion is assigned using the mono-isotopic peak only. In other words a value corresponding to the mass of the fragment ion used for calibration is assigned using the fragment ion mono-isotopic peak only and said value is used to calibrate the spectrometer.

25 Claims, 6 Drawing Sheets

CALIBRATION METHOD

BACKGROUND OF THE INVENTION

1. Field of the Invention

This invention relates to a method for calibrating a mass spectrometer. In particular, this invention relates to a method for calibrating a mass spectrometer using the mass spectrum of daughter or fragment ions produced by post-source decay of a meta-stable ion in a reflectron time-of-flight (TOF) mass spectrometer.

2. Description of Related Art

In a TOF mass spectrometer, meta-stable ions (also referred to as pre-cursor ions) are generated in an ion source from a sample and repelled from the source into a drift region. In the drift region, these meta-stable ions may break into fragments in a process known as post-source decay. Alternatively, post-source decay may be induced by laser or within a collision cell to produce fragment ions. These fragment or daughter ions are useful for determining the structure of the sample from which the meta-stable ions are generated. For example, in the case of a peptide sample, these daughter ions are related to the amino acid composition of the sample molecule and can therefore be used to deduce sequence information.

In this specification the terms parent ion, meta-stable ion and pre-cursor ion will be used interchangeably as will the terms daughter ion and fragment ion.

When analysing a sample by normal TOF mass spectrometry i.e. with or without a reflectron, the user is presented with data relating to the time that the ions have taken to travel through the drift region. The time taken is dependent on the mass to charge ratio of the ion. In order to convert the time of flight data into the more useful mass data, it is necessary to calibrate the mass spectrometer using a spectrum of a known compound in which the molecular identity and therefore the molecular weight of the ions observed is known. In this way it is possible to correlate flight time and molecular weight so that on analysing an unknown compound, it possible to assign weights to the unknown peaks on the basis of the flight time for the peak.

In a reflectron TOF mass spectrometer, the daughter ions formed in post-source decay are separated according to their velocity and according to their energy (which is related to their mass); whereas normal, parent ions all have approximately the same energy (having been accelerated by the same potential) and are separated according to their velocity only. Therefore the mass calibration for the daughter ions is not the same as for the normal (original meta-stable) ions.

Ions which undergo post source decay (PSD) do so (by definition) in the field free region. Thus ions that fragment in the source or the reflectron are not detected in the PSD fragment spectrum—either because they are selected out or do not reach the detector in time focus. Because there are no external fields (no external forces on the ions) momentum is conserved and all the fragments retain the velocity of the pre-cursor ion i.e., the velocity with which it left the ion source. The kinetic energy of the ions is given by the following equations:

$$\text{Pre-cursor: } E_p = \tfrac{1}{2} m_p v_p^2$$

$$\text{Fragment ion: } E_f = \tfrac{1}{2} m_f v_p^2$$

where $E_p$=Kinetic energy of precursor ion, $E_f$=kinetic energy of fragment ion, $m_p$=mass of precursor ion, $m_f$=mass of fragment ion and $v_p$=velocity of precursor ion).

Thus it follows that the ratio of the mass of a fragment ion to that of the pre-cursor is the same as the ratio of their kinetic energies:

$$m_f/m_p = E_f/E_p$$

In a linear time-of-flight mass spectrometer we can see that because the velocities of the fragment and pre-cursor ions are the same there is no way of distinguishing between them—they arrive at the detector at the same time and therefore have the same measured mass.

In a reflectron time-of-flight mass spectrometer ions encounter a retarding field in the reflectron and travel into the reflectron to the point where their potential energy equals their kinetic energy. The ions are then turned around and reflected back out to emerge from the reflectron with the same speed but in the reverse direction. The reflectron is an energy analyser and can thus distinguish between pre-cursor ions and fragment ions and also fragment ions of different mass. This is the principle of fragment mass analysis in a reflectron time-of-flight mass spectrometer whatever type of reflectron is used. It applies to linear field reflectrons, where the voltage is stepped or scanned over multiple experiments in order to build up a complete fragment spectrum and also to curved field or quadratic field reflectrons which allow the fragment spectrum to be acquired in one shot.

The calibration of the time of flight spectrum for fragments is not the same as that of the pre-cursor ions. In the normal pre-cursor ion spectrum the ion energy is essentially the same for all mass whereas for the fragment ions there is a dependence of the ion energy on mass for the flight time in the reflectron. It is possible to calculate the calibration function for the fragment ions and relate this to the normal calibration function for the pre-cursor ions. Usually, the fragment mass calibration will depend on the ratio of the fragment mass with respect to the pre-cursor ion mass. However, for best mass accuracy and for practical reasons a calibration will be based typically on a fragment mass spectrum of a known compound. Typically a single known compound which gives rise to eight or so known fragments (of known masses) is used.

In the example of a curved field reflectron the basic calibration function has a form as follows. The actual mass, $m_{act}$ of the fragment ion can be related to the apparent mass, $m_{app}$ that would be measured using the normal mass calibration (i.e., that of the pre-cursor ions). The ratio $m_{act}/m_{app}$ follows a curve which depends only on the ratio of $m_{act}$ to the pre-cursor mass, $m_{pre}$. By knowing the $m_{act}$ for a standard compound and measuring the $m_{app}$ the calibration curve can be defined for all pre-cursor masses. An example of such a curve is shown in FIG. 1. It can be seen from FIG. 1 that if the fragment has the same mass as the precursor ion, the apparent measured mass will be the same as the real mass. If however the fragment ion's actual mass is less than the precursor ion, the apparent measured mass ($m_{app}$) of the fragment ion will be greater than its actual mass ($m_{act}$). In FIG. 1 the apparent mass of the fragment ion is approximately 1.4 times its actual mass when the actual fragment mass is 10% of the precursor ion mass. The exact shape of the calibration curve will be different for each spectrometer depending upon the reflectron and drift tube dimensions.

The inventors have realised that conventional methods of calibrating for PSD fragments in a reflectron mass spectrometer introduce errors into the calibration and lead to inaccurate mass measurement. This is due to a complication caused by the fact that the parent meta-stable ion has a natural isotope distribution, for example, from the natural abundance of carbon 13 isotopes in the molecule. The current invention provides a method of correcting for or avoiding these errors.

The errors and a method of correcting for or avoiding them are explained below.

BRIEF SUMMARY OF THE INVENTION

One embodiment of the present invention is directed to a method of calibrating a reflectron time-of-flight mass spectrometer using a spectrum generated by fragment ions wherein a mass of a fragment ion is assigned using mono-isotopic peak only.

Another embodiment of the present invention is directed to a method of analysing a spectrum of fragment ions generated by a reflectron time-of-flight mass spectrometer. A mass of a fragment ion is assigned using a mono-isotopic mass peak only.

A further embodiment of the present invention is directed to a calibration apparatus for use in a mass spectrometer. The calibration apparatus includes means for selecting only a mono-isotopic peak in a distribution pattern of a fragment ion; and means for assigning a mass to the selected mono-isotopic peak.

DETAILED DESCRIPTION OF THE INVENTION:

Many atoms have more than one stable (non-radioactive) isotope, i.e., differing in the number of neutrons within the nucleus. The most common example is that of carbon $^{12}C$ which has 6 protons and 6 neutrons giving a nominal mass of 12 Da but has a stable isotope with 7 neutrons, denoted $^{13}C$ and a mass of 13 Da. The $^{13}C$ isotope has a natural abundance of 1.1% so that on average just over 1 in 100 carbon atoms is $^{13}C$. Similar behavior is seen for nitrogen, oxygen and sulphur. All of these atoms are present in significant quantities in organic molecules such as peptides and proteins so that the mass spectrum will show not one single peak but a distribution of peaks 1 Da apart according to the size of the molecule and the natural abundance of the isotopes of the atoms that make it up.

Figure 2:
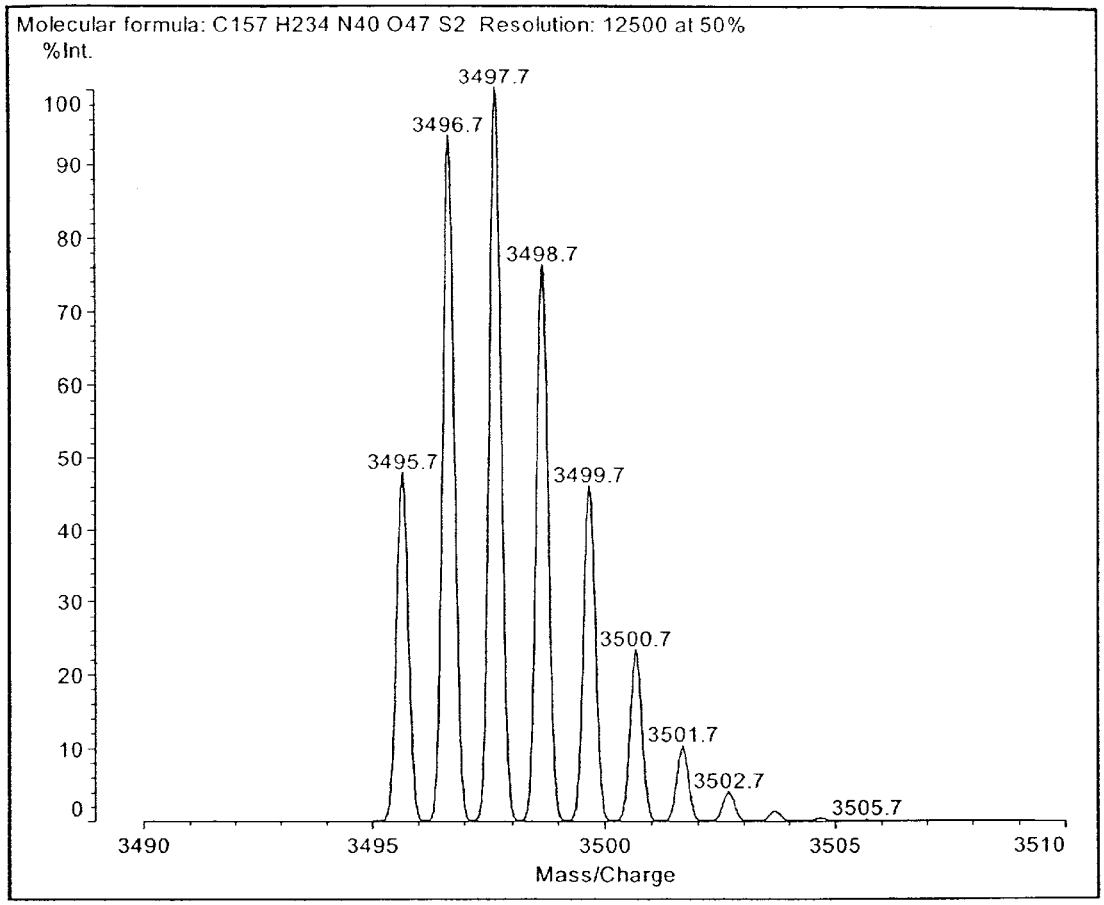
FIG. 2 shows the mass spectrum of the insulin b-chain.

FIG. 2 shows the mass spectrum of the insulin b-chain. It can be seen that there are several peaks, each 1 Da (Dalton) apart due to the presence of isotopes in the insulin b-chain sample.

Similarly, fragment molecules also show isotope distributions. However the inventor has noticed that the separation of isotopic peaks in the fragment ion are not separated by 1 Dalton. The inventor has studied this phenomena and devised a method of spectrometer calibration and PSD fragment mass measurement which takes this into account and thus is more accurate than the prior art. This phenomena which has not previously been noticed, is described in more detail below.

The higher mass isotopes will be distributed randomly throughout the pre-cursor molecule and, in the absence of any unusual chemical effects, the higher mass isotopes will also be randomly distributed within the fragment molecule. When the fragmentation process occurs molecules with higher mass isotopes can therefore only form fragment ions with up to the same number of higher mass isotopes (but not more!).

In post-source decay this has a significant effect on the mass accuracy because fragments with the same number of higher mass isotopes (and therefore the same mass) can be produced by a pre-cursor with differing numbers of higher mass isotopes. For example, one parent ion will have a natural carbon 13 abundance and as this ion decays some daughter ions will contain only carbon 12 whilst other daughter ions will contain varying percentages of carbon 13.

Figure 3:
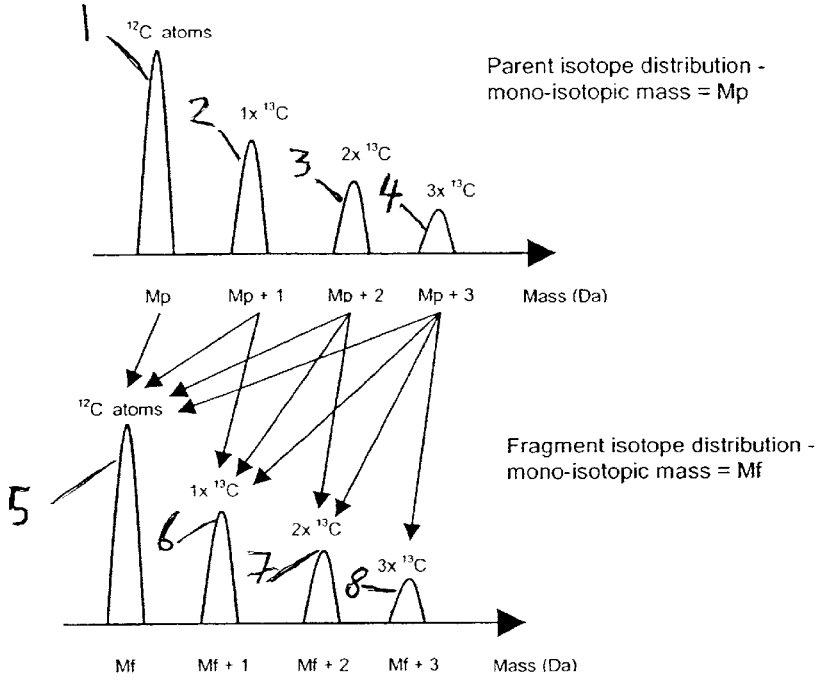
FIG. 3 illustrates the relationship between the parent isotope and fragment isotopes.

FIG. 3 shows how fragments with the same number of higher mass isotopes can be produced by precursor ions with differing numbers of higher mass isotopes. In the interests of clarity FIG. 3 only considers the $^{13}C$ carbon isotope which is the most significant isotope for organic compounds.

The top part of FIG. 3 shows the isotopic distribution of the parent ion, there are four peaks and each peak represents a parent ion with a different number of isotopes. The first peak 1 represents the mono-isotopic parent ion in which all of the carbon atoms are $^{12}C$ atoms. The second peak 2 represents a parent ion containing only one $^{13}C$ isotope. The third peak 3 represents a parent ion containing two $^{13}C$ isotopes and the fourth peak 4 represents a parent ion containing three $^{13}C$ isotopes. The peaks are equally spaced and 1 Dalton apart from each other, so as shown in FIG. 3 the mass of the first peak is Mp Daltons (where Mp is the mono-isotopic mass of the parent ion), the second peak mass is (Mp+1) Daltons, the third peak (Mp+2) Daltons and the fourth peak (Mp+3 Daltons).

The bottom part of FIG. 3 shows the isotopic distribution of a fragment ion originating from the precursor ion shown at the top of the FIG. 3. The distribution is shown by four peaks, again each peak represents a fragment ion containing a different number of $^{13}C$ isotopes. The first peak 5 represents the mono-isotopic fragment ion which contains $^{12}C$ atoms only and no isotopes, the second peak 6 represents a fragment ion which contains one $^{13}C$ isotope only, the third peak 7 represents a fragment ion which contains two $^{13}C$ isotopes and the fourth peak 8 represents a fragment ion which contains three $^{13}C$ isotopes. The actual mass of the ion represented by the first peak 5 is Mf Daltons(Mf=the mono-isotopic mass of the fragment ion), the actual mass of the ion represented by the second peak 6 is (Mf+1) Daltons, (Mf+2) Daltons for the third peak 7 and (Mf+3) Daltons for the fourth peak 8. In a real mass spectrometer the measured masses and generated mass spectrum will be different as is explained later.

The arrows between the top and the bottom parts of FIG. 3 show the relationship between the isotopic distributions of the fragment and precursor ions. It shows which isotopic fragment ions can be produced by which isotopic precursor (parent) isotopic ions.

The mono-isotopic fragment ion 5 can be produced by any of the isotopic forms of the parent ion 1, 2, 3 or 4 as all of these will contain $^{12}C$ atoms.

The first isotopic fragment ion 6 cannot be produced by the mono-isotopic parent ion (as the mono-isotope does not contain any $^{13}C$ atoms), but can be produced by any one of the non-mono-isotopic parent ions 2, 3, or 4.

The second isotopic fragment ion 7 can be produced by any parent ion which contains at least two $^{13}C$ atoms, i.e. by the second and third parent ion isotopes 3 and 4.

The third isotopic fragment ion 8 can only be produced by a parent ion having at least three $^{13}C$ atoms, i.e. only by the third isotopic parent ion 4.

The measured mass of each fragment ion isotope will depend upon the parent isotope which it came from. As the ratio $m_{act}/m_{pre}$ (the ratio of actual fragment ion mass to precursor ion mass) is different for each parent isotope, the calibration curve is slightly different and hence the measured mass will also be slightly different.

The difference in measured mass depends on the type of reflectron and the dimensions of the mass spectrometer but is finite for all instruments. It can be described as an offset in mass $m_o$ such that the difference between the actual and measured mass of the fragment ion is $m_o$ x n Daltons (Da) where, $m_o$ is a mass offset parameter and n is extra mass (in Daltons) of the higher mass isotopic parent ion. (In the example of FIG. 3, n is the number of $^{13}C$ atoms contained in the parent).

This mass offset effect can influence the mass measurement accuracy in two ways. Firstly, it leads to a broadening of the mass peak which effectively reduces mass resolution of the measurement. Secondly, the measured separation of the isotope peaks is not 1 Da but actually $(1+m_o)$Da, where $m_o$ is a parameter characterizing the mass offset. These effects are illustrated in FIGS. 4 and FIGS. 5*a* and 5*b*.

Figure 4:
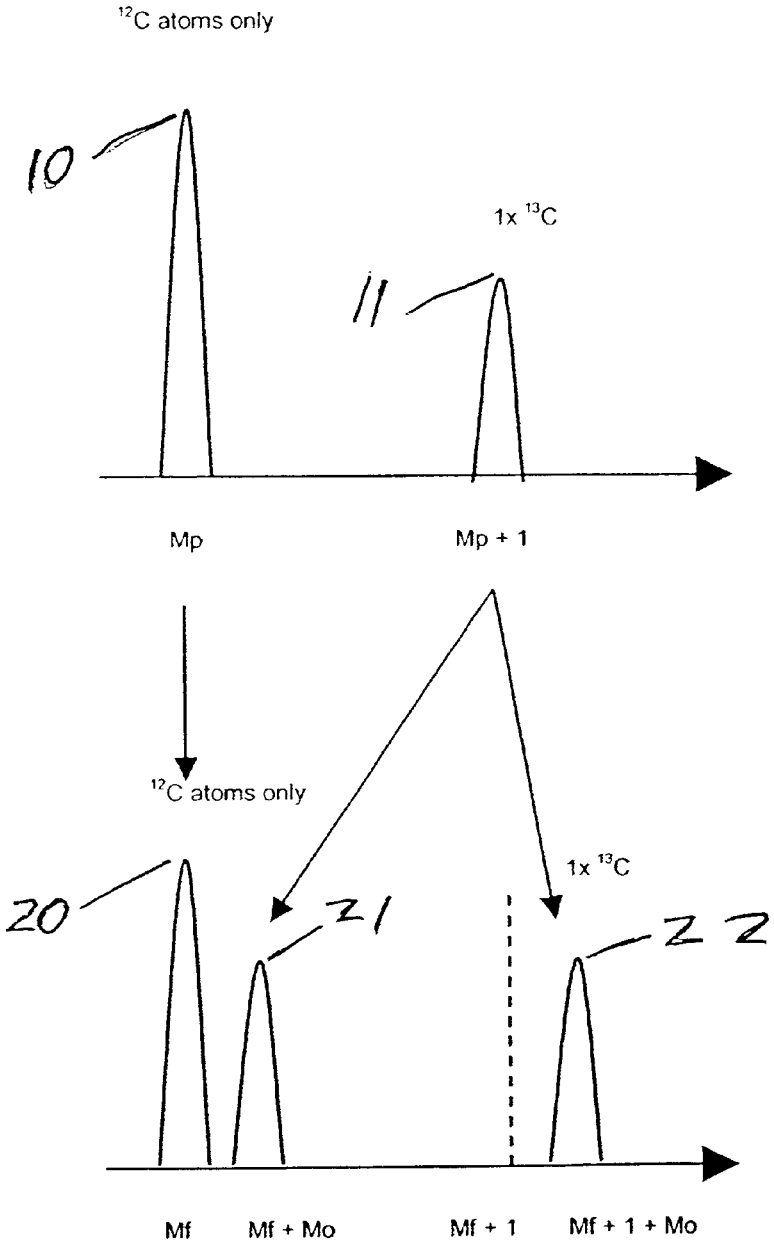
FIG. 4 illustrates how a mass offset effect can occur due to the isotopic distribution of the precursor ion.
Figure 5B:
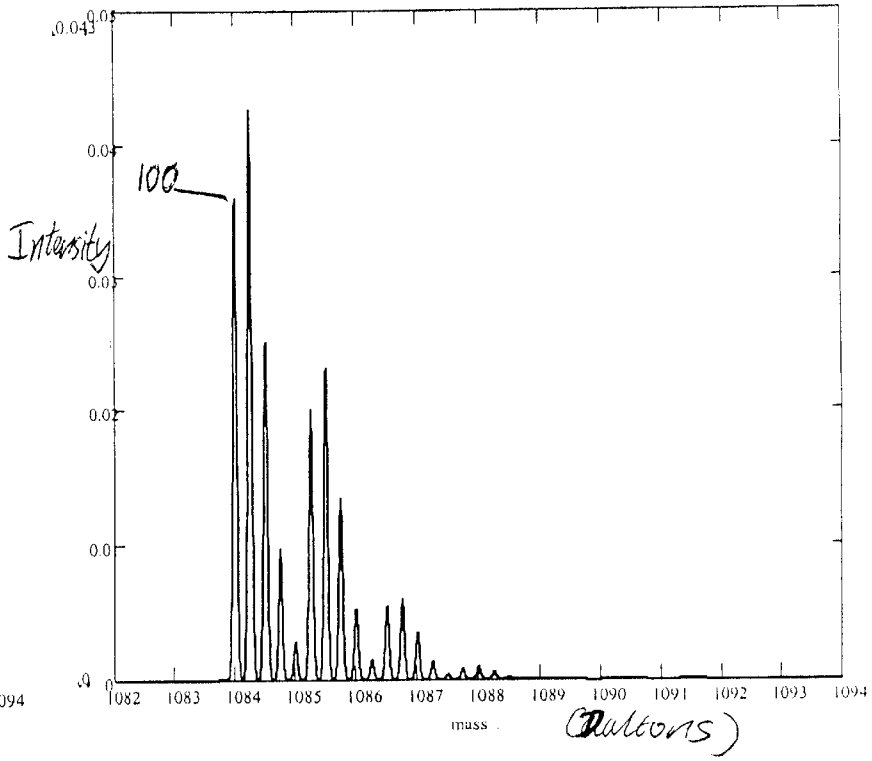
FIG. 5*b* shows an example of a mass spectrum for the same fragment ion as FIG. 5*b* but with a mass offset set at $m_o$=0.25, ($m_o$ is a parameter which determines the mass offset)
Figure 5A:
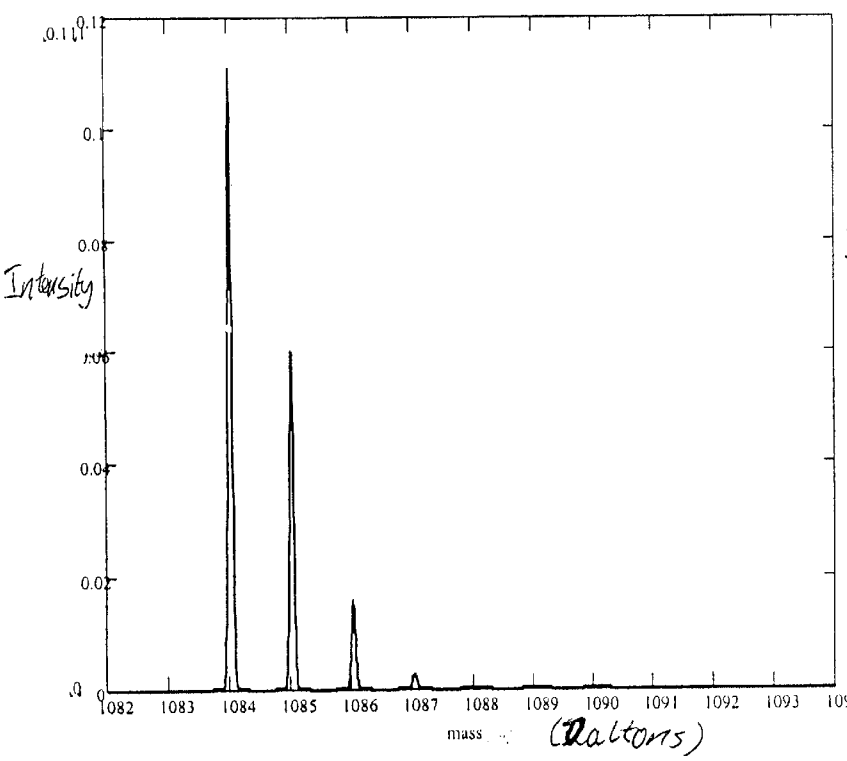
FIG. 5*a* shows an example of a fragment ion mass spectrum with no mass offset ($m_o$=0)

FIG. 4 shows this mass offset effect for the fragment ions resulting from a sample containing the parent ions 1 and 2 of FIG. 3.

The top part of FIG. 4 shows the mass spectrum which will be generated in the spectrometer by the parent ions. The first peak 10 is the mono-isotopic peak (generated by a parent ion 1 in which all the carbon atoms are $^{12}C$ atoms) and the second peak 11 is the peak resulting from a parent ion 2 which has the same chemical formula as the parent ion 1, but in which one of the carbon atoms is a $^{13}C$ atom.

The bottom part of FIG. 4 shows the peaks which will be generated in the spectrometer by the fragment ions. The first peak 20 is the mono-isotopic peak. The mono-isotopic peak is the peak generated by a mono-isotopic fragment ion which originated from a mono-isotopic parent ion. This relationship with the mono-isotopic parent ion is shown in FIG. 4 by an arrow pointing from the mono-isotopic parent peak 10 to the fragment ion's mono-isotopic peak 20.

The second peak 21 is the peak generated by a mono-isotopic fragment ion originating from a parent ion having one $^{13}C$ atom amongst its carbon atoms. The actual mass of the fragment ion generating the peak 21 is the same as the actual mass of the fragment ion which generates the mono-isotopic peak 20, however its measured mass is greater because the ratio of the parent mass to the fragment is different.

The measured mass of the fragment ion which generates the mono-isotopic peak 20 is the same as its actual mass: Mf; the ratio of pre-cursor (parent) ion mass to actual fragment ion mass is Mp/Mf.

The actual mass of the fragment ion which generates the second peak 21 is also Mf, but its measured mass is $Mf+m_o$; the ratio of pre-cursor to actual fragment mass for this fragment ion is Mp+1/Mf. As there are two peaks relating to the same actual mass fragment ion, the resolution of the spectrometer for fragment ions is reduced.

The third peak 22 shown at the bottom part of FIG. 4 is generated by a fragment ion containing one $^{13}C$ isotope which originated from a parent ion containing one $^{13}C$ isotope. The vertical dashed line in FIG. 4 shows the point 1 Dalton away from the mono-isotopic peak 21. It can be seen that due to the above described offset effect the spacing of the mono-isotopic peak 20 from the peak 22 is not 1 Dalton, but $(1+m_o)$ Daltons. The value of $m_o$ depends upon other things on the type and size of the reflectron used.

This mass offset effect is a consequence of the fact that a fragment ion cannot have more higher mass isotopes than were in the pre-cursor ion that produced it. The effect is to shift the average of the mass distribution to higher mass by an amount depending on the abundance of higher mass isotopes in the pre-cursor ion and the size of $m_o$.

While the offset effect has been described above with regard to the $^{13}C$ isotope, it is not just carbon which produces this effect but also other isotopes such as nitrogen 15 and isotopes of oxygen and sulphur.

FIG. 5*a* is a mass spectrum showing the isotopic distribution of fragment ions without the mass offset effect (i.e. $m_o$=0). FIG. 5*b* is a mass spectrum of the same fragment ions when the mass offset is $m_o$=0.25. FIGS. 5*a* and 5*b* were generated by a computer model. It can be seen that the offset skews the shape of the mass spectrum towards the heavier masses.

Figure 1:
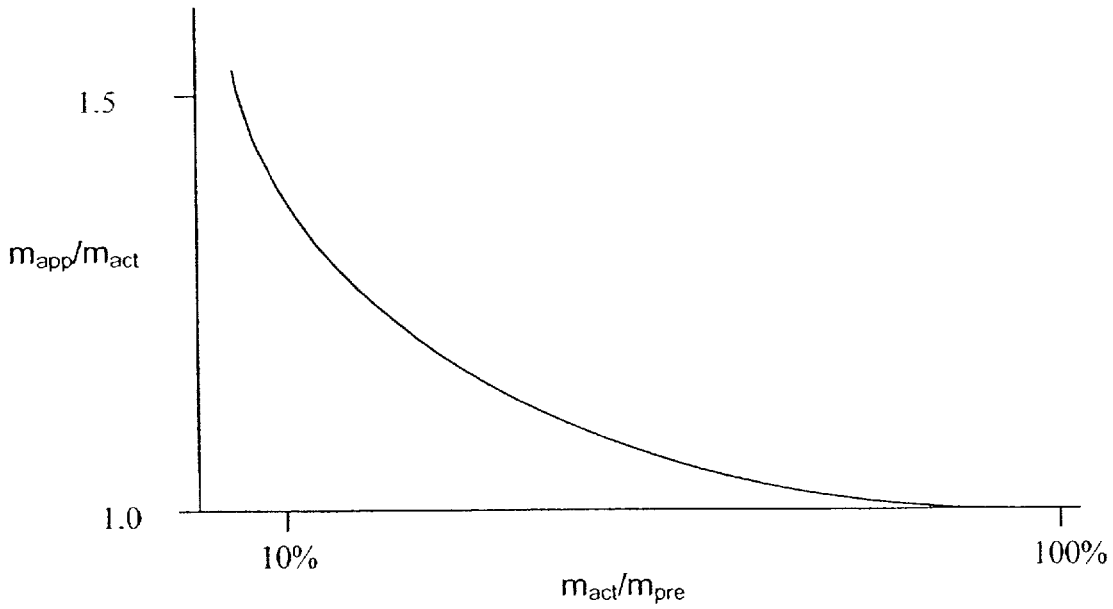
FIG. 1 illustrates the relationship between the ratio of the apparent mass of a fragment to the actual mass and the actual mass of the fragment to the pre-cursor mass.

While the above has been discussed in relation to a 'mass offset', it will be clear to a person skilled in the art that this could also be termed a 'time of flight offset' as mass need only be assigned to the various times of flight of the fragment ions at the end of the calibration process. The above discussion has assumed that the times of flight of the fragment ions are first converted to mass according to the parent ion calibration and then adjusted according to a calibration curve, e.g. such as that shown in FIG. 1. However it would also be possible to work in time of flight and to adjust the time of flight of the fragment ions with a similar calibration curve before finally assigning a mass at the end of the calibration process. However the above principles remain the same whether working in time of flight or mass.

It is possible to use a "smoothing" technique on the fragment mass isotopic distribution but this may lead to an error in the mass assignment as smoothing involves selection of a peak (usually the most abundant peak) and the centering of the distribution on this peak using an algorithm. In practice this smoothing leads to an averaging of the mass peaks in the distribution pattern, this average usually being distorted from the accurate mass by the higher mass isotope peaks within the distribution.

The following invention aims to ameliorate the above problems.

In its most general terms the invention achieves this by compensating for the effect of the mass offset in the calibration method. This can be achieved either by correcting for the offset or assigning mass to the peaks in such a way that the offset is avoided. Accordingly in a first aspect there is provided a method of calibrating a reflectron time-of-flight mass spectrometer using a spectrum generated by fragment ions wherein the mass of the fragment ion is assigned using the mono-isotopic peak only.

In other words a value corresponding to the mass of the fragment ion used for calibration is assigned using the fragment ion mono-isotopic peak only and said value is used to calibrate the spectrometer.

Typically the spectrum will have a plurality of peaks, which may be termed as mass peaks or time of flight peaks depending (as discussed above) on whether the time of flight has been converted to mass.

In this context the mono-isotopic peak is the peak corresponding to the fragment ion containing only the most naturally abundant isotopes of each element and originating from a parent ion containing only the most naturally abundant isotopes of each element—i.e. the mono-isotopic fragment peak is the peak generated by a mono-isotopic fragment originating from a mono-isotopic precursor ion. In practice this will be the lowest mass peak in the distribution pattern. For example in the fragment spectrum shown in FIG. 5*b* the mono-isotopic peak is the peak labelled 100 and having a mass of 1084 Daltons.

By selecting the mono-isotopic peak only, the characteristics of the daughter ion isotope distribution (and the mass offset) are prevented from affecting the calibration process thus improving mass accuracy of the daughter ions.

The mono-isotopic peak can be determined by inspection if the individual isotopic peaks are sufficiently resolved (e.g. as in FIG. 5*b*).

Alternatively the mono-isotopic peaks can be determined by an algorithm. This can be particularly useful if the isotopic peaks are not fully resolved. Several algorithms which are capable of determining the mono-isotopic peak even when the isotopic peaks are not resolved. Many such algorithms assume that the separation of the isotopic peaks is 1 Dalton.

Preferably the algorithm is adapted to take into account the mass offset caused by the isotopic distribution of the parent ions. Most preferably this involves use of the mass offset parameter $m_o$ which is described above. Typically this will involve the algorithm calculating the separation of the isotopic peaks according to the formula isotopic peak separation $=(1+m_o)$ Daltons, where $m_o$ is a mass offset parameter which depends upon the spectrometer and reflectron used. This formula is an approximation, because as will be appreciated the mass offset leads to numerous isotopic peaks, some of which have a separation of less than 1 Dalton. However the algorithms generally work assuming that the isotopic distribution has no mass offset (e.g. as shown in FIG. 5*a*) and that the peaks are separated by 1 Dalton and therefore the $(1+m_o)$ Daltons formula is a good approximation for the purposes of the mono-isotopic peak finding algorithm. This is because each isotopic form of the fragment ion will give rise to a plurality of peaks (one for each possible parent isotopic ion) and the highest peaks in these pluralities will generally be separated by $(1+m_o)$ Daltons.

The calibration method is preferably carried out using a sample which undergoes post-source decay into fragment ions of known molecular identity.

In preferred embodiments, the parent ion peak i.e. the peak corresponding to the original, unfragmented metastable ion is also assigned in the calibration method. Preferably the mass of the parent ion is assigned by using only the mono-isotopic parent peak.

Accordingly in a second aspect, there is provided a method of analysing a spectrum of fragment ions generated by a reflectron time-of-flight mass spectrometer wherein the mass of the fragment ion is assigned using the mono-isotopic peak only.

The mono-isotopic peak may be determined according to any of the methods described above for the first aspect of the invention.

Preferably, this method of analysing is preceded by a calibration step using the calibration method according to the first aspect of the present invention. Thus both in the calibration of the spectrometer and its subsequent use in measuring fragment masses, the mass is assigned by the mono-isotopic peaks only so as to avoid errors arising from the mass offset effect.

The methods described above can be applied to a spectrum generated by any reflectron time-of-flight mass spectrometer irrespective of the shape of the static field in the reflectron. For example, the method is applicable to a reflectron time-of-flight mass spectrometer where the shape of the electrostatic field on the reflectron is a curved field, a quadratic field or a linear field (e.g. a single or dual sloped field). Additionally, the methods can be used for spectra generated in cases where the voltage on the reflectron is applied as a single pulse or in a scanning mode.

In a third aspect there is provided a calibration apparatus for use in a mass spectrometer, the calibration apparatus including:

means for selecting only a mono-isotopic peak in a distribution pattern of a fragment ion peak in a mass spectrum; and means for assigning a mass to the selected mono-isotopic peak.

In most cases, the mass spectrum will show peaks relating to a plurality of fragment ions of different molecular identities. There will be a plurality of peak clusters, each cluster relating to fragment ion having a different molecular identity. As the peaks in each respective peak cluster all relate to one molecular identity, the peak cluster can be termed an isotopic distribution pattern. In these cases, the selecting means and assigning means selects and assigns the mono-isotopic peak in some or all of the distribution patterns.

The mono-isotopic peak can be determined and selected according to any of the methods described above for the first aspect of the invention.

The means for selecting the mono-isotopic peak may be an interface for allowing the mass spectrometer operator to select and assign the mono-isotopic peak.

Alternatively the means for selecting the mono-isotopic peak could be an algorithm (such as that described above under the first aspect of the invention) for determining and selecting the mono-isotopic peak. In this case the mono-isotopic peak can be elected automatically by the calibration apparatus without input from a human operator.

Preferably, the calibration apparatus also includes display means for displaying the mass spectrum showing the distribution pattern(s) of the fragment ion(s). There may also be means for receiving the spectrum data from a mass spectrometer and/or means for outputting calibration data to a mass spectrometer.

Preferably, the calibration apparatus includes a microprocessor programmed with suitable software.

In especially preferred embodiments, the calibration apparatus is integral with the mass spectrometer.

In a fourth aspect there is provided a reflectron time-of-flight mass spectrometer including calibration means according to the third aspect of the present invention.

The mass spectrometer may be any reflectron time-of-flight mass spectrometer irrespective of the shape of the static field in the reflectron. For example, the spectrometer may have a curved field, a quadratic field or a linear field (e.g. a single or dual sloped field) applied to the reflectron. Additionally, the spectrometer may have a reflectron where the voltage is applied as a single pulse or in a scanning mode.

A preferred embodiment of the invention will now be described with reference to the accompanying figures.

A PSD reflectron mass spectrometer is provided with calibration software for calibrating the spectrometer and mass assignment software for assigning the mass of unknown peaks once the spectrometer has been calibrated.

The spectrometer is calibrated for parent ions by analysing a compound of known molecular identity and assigning masses to the observed peaks on the basis of the known molecular identity of the compound. In this way time of flight is correlated with molecular weight and so when an unknown compound is analysed by the spectrometer the unknown peaks can be assigned masses based on this correlation.

The fragment ion calibration is carried out separately after the spectrometer has been calibrated for parent ions. A known compound which gives rise to ten known PSD fragments is analysed.

For each fragment ion the mono-isotopic peak (that is the peak corresponding to a mono-isotopic fragment ion which has decayed from a mono-isotopic parent ion is determined. This may be done visually by inspection (i.e. by the mass spectrometer operator) or automatically by an algorithm built into the calibration software.

Once the mono-isotopic peak for each fragment has been selected it is used to calibrate the spectrometer for fragment ions using conventional methods. As the known compound gives rise to ten known fragment ions of known mass the spectrometer can be calibrated along the range of fragment to precursor ion mass ratios. It is important that it is the mono-isotopic peaks which are used as this avoids a mass offset error caused by the fact that each fragment ion could have decayed from one of several isotopic parent ions.

A suitable algorithm for selecting the mono-isotopic peak from the fragment isotopic peak distribution is described in the publication E J Breen, F G Hopwood, K L Williams, Mr Wilkins, Electrophoresis 2000, 21, 2243–2251. This algorithm uses the calculated isotope amplitude distribution to pick the mono-isotopic peak and is capable of doing so even when the isotopic peaks are not fully resolved. The algorithm assumes that the separation of the isotopic peaks is one Dalton and so will need to be adjusted by specifying that the separation is $(1+m_o)$ Daltons. $m_o$ is a mass offset parameter which depends upon the spectrometer and type of reflectron used. Three ways of calculating $m_o$ will now be described. $m_o$ can be calculated from knowledge of the flight times of three ions as follows: The time of flight of the mono-isotopic fragment ion mass $m_f$ produced from the parent ion of mono-isotopic mass $m_p$ written: TOF(mf, $m_p$). The time of flight of the mono-isotopic fragment ion mass mf but produced from the first isotope (i.e. containing a single $^{13}C$ atom) of the parent mass $m_p$+l written: TOF($m_f$, $m_p$+1).

The time of flight of the fragment mass $m_f$+1 from the mono-isotopic parent mass $m_p$is TOF($m_f$+1$m_p$).

The difference in flight time for fragment ions differing in mass by 1 Da, from the same mass pre-cursor ion is $$\Delta TOF_f = TOF(m_f 1, m_p) - TOF(m_f, m_p)$$

The difference in flight time for the mono-isotopic fragment from two pre-cursor isotopes 1 Da apart is $$\Delta TOF_p = TOF(m_f m_p + 1) - TOF(m_f, m_p)$$

The fragment mass offset, $m_o$ is simply the ratio of these two times:

$$m_o \Delta TOF_p / \Delta TOF_f$$

The flight times of the pre-cursor and fragment ions (preferably at least three ion masses are needed) may be determined in several ways for example:

1. By constructing an ion trajectory model of a reflectron ToF mass spectrometer and measuring the time of flight of the ions simulated in the model.
2. By calculating the time of flight of the different ions explicitly using the equations of motion of ions in the electric fields as produced by a reflectron ToF mass spectrometer
3. By measuring experimentally using a reflectron ToF mass spectrometer with appropriate mass resolution on PSD data with compounds giving suitable isotope distributions.

The first two methods of calculating time of flight have been described in publications by the inventor for example A Bowdler and E Raptakis, 47$^{th}$ ASMS Conference on Mass Spectrometry and Allied Topics, June, 1999.

An example of method 2 will now be provided.

If we consider PSD of the molecule insulin B chain, mass 3496.7 Da and its fragment at 1086.6 Da. The time of flight for a reflectron ToF MS of the 1086.6 Da fragment is 39.672 $\mu$s where ions are generated in the ion source at 20 kV, the length of the flight tube is 1.2 m and a curved field reflectron of length 0.365 m is used. In this case $\Delta TOF_f$ is 0.0105 $\mu$s and $\Delta TOF_P$ is 0.0024 $\mu$s so that $m_o$ is about 0.24 Da.

The same calculation can be made where the reflectron is a linear field (single stage) reflectron of length 0.2 m where the reflectron voltage has been reduced to 7.5 kV so that the fragment ion is in focus. In this case the time of flight of the 1086.6 Da fragment is 48.155 $\mu$s, $\Delta TOF_f$ is 0.0176 $\mu$s and $\Delta TOF_P$ is 0.0018 $\mu$s so that $m_o$ is about 0.1 Da.

Figure 6:
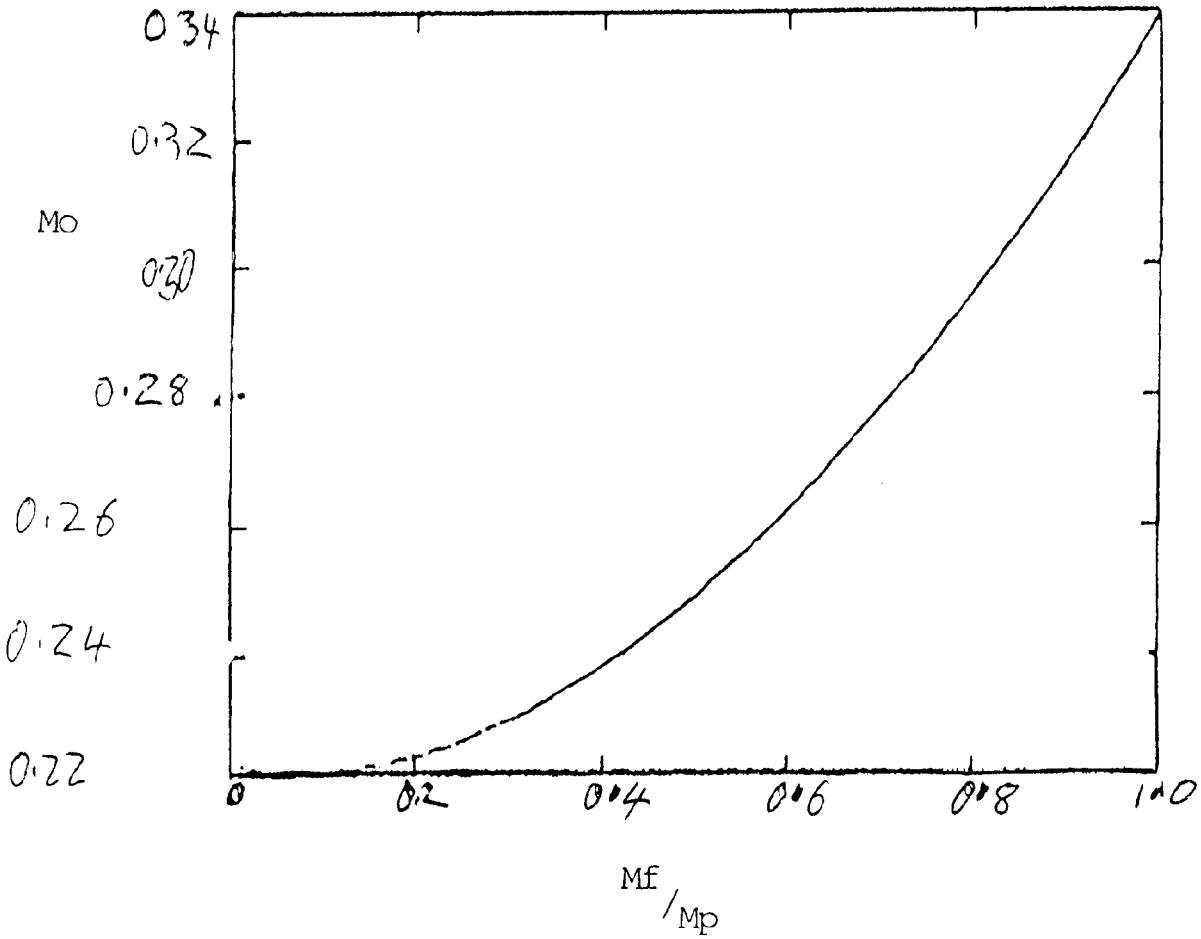
FIG. 6 is a graph showing the relationship between the mass offset parameter $m_o$ and $m_f/m_p$ (the ratio of actual fragment mass to precursor mass) in a curved field reflectron spectrometer.

The calculation can be extended to the whole fragment mass range and FIG. 6 shows a plot of $m_o$ as a function of $m_f/m_p$ for a curved field reflectron spectrometer. The plot was calculated using method 2 on a Math CAD package. Alterations and modifications to the above disclosure that fall within the scope of the present invention will be readily apparent to those skilled in the art.

What is claimed is:

1. A method of calibrating a reflectron time-of-flight mass spectrometer using a spectrum generated by fragment ions wherein a mass of a fragment ion is assigned using a mono-isotopic peak only.

2. A method according to claim 1 wherein the mono-isotopic peak is determined by inspection.

3. A method according to claim 1 wherein the mono-isotopic peak is determined by a peak finding algorithm.

4. A method according to claim 3 wherein the algorithm takes into account that measured isotopic peaks are separated by more than their real mass separation.

5. A method according to claim 4 wherein the algorithm calculates separation of the measured isotopic peaks as being $(1+m_o)$ Daltons where $m_o$ is a parameter depending upon the mass spectrometer.

6. The method of claim 1 wherein the method is carried out using a sample of known molecular identity which undergoes post-source decay into fragment ions of known molecular identity.

7. The method of claim 1 wherein the method further includes the step of assigning a mass of a parent ion peak.

8. A method of analysing a spectrum of fragment ions generated by a reflectron time-of-flight mass spectrometer wherein a mass of a fragment ion is assigned using a mono-isotopic mass peak only.

9. A method of analysing a spectrum of fragment ions according to claim 8 wherein the mono-isotopic peak is determined by inspection.

10. A method of analysing a spectrum of fragment ions according to claim 9 wherein the mono-isotopic peak is determined by a peak finding algorithm.

11. A method of analysing a spectrum of fragment ions according to claim 10 wherein the algorithm takes into account that measured isotopic peaks are separated by more than their real mass separation.

12. A method of analysing a spectrum of fragment ions according to claim 8 further comprising a step of calibrating the reflectron time-of-flight mass spectrometer using a spectrum generated by fragment ions wherein a mass of each fragment ion is assigned using a mono-isotopic peak only.

13. A calibration apparatus for use in a mass spectrometer, the calibration apparatus including:

means for selecting only a mono-isotopic peak in a distribution pattern of a fragment ion; and means for assigning a mass to the selected mono-isotopic peak.

14. The apparatus of claim 13 wherein the selecting means has an input means which allows an operator to select the mono-isotopic peak.

15. The apparatus of claim 13 wherein the selecting means operates according to a peak finding algorithm.

16. The apparatus of claim 15 wherein the peak finding algorithm takes into account the fact that measured isotopic peaks in the distribution pattern are spaced by more than their real mass separation.

17. A reflectron time of flight mass spectrometer including a calibration apparatus according to claim 13.

18. A reflectron time of flight mass spectrometer according to claim 17 wherein the spectrometer further includes analysing means for analysing the spectrum of a fragment ion.

19. A method of calibrating a reflectron time-of-flight mass spectrometer using a spectrum generated by fragment ions wherein a mass of the fragment ion is assigned using a mono-isotopic peak only, wherein the mono-isotopic peak is determined by a peak finding algorithm and the algorithm calculates separation of the isotopic peaks as being $(1+m_o)$ Daltons where $m_o$ is a parameter depending upon the mass spectrometer, and wherein the method further includes the step of assigning the mass of a parent ion peak.

20. A method of calibrating a spectrum of fragment ions generated by a reflectron time-of-flight mass spectrometer wherein only a mono-isotopic peak corresponding to a fragment ion is used to assign the fragment ion's mass.

21. A method of analysing a spectrum of fragment ions according to claim 11, wherein the algorithm calculates separation of the measured isotopic peaks as being $(1+m_o)$ Daltons where $m_o$ is a parameter depending upon the mass spectrometer.

22. A method of calibrating a reflectron time-of-flight mass spectrometer using a spectrum generated by fragment ions, wherein mono-isotopic peaks of the fragment ions are determined by a peak-finding algorithm, the algorithm taking into account that measured isotopic peaks from the fragment ions are separated by more than their real mass separation, the fragment ions being assigned a mass using their mono-isotopic peaks only.

23. A method of calibrating a reflectron time-of-flight spectrometer according to claim 22, wherein the algorithm calculates that the isotopic peaks are separated by $(1+m_o)$ Daltons where $m_o$ is a parameter depending upon the mass spectrometer.

24. A calibration apparatus for use in a mass spectrometer, the calibration apparatus including:

selecting means for determining and selecting a mono-isotopic peak in a distribution pattern of a fragment ion, the selecting means operating according to a peak-finding algorithm, the algorithm taking into account that measured isotopic peaks from the fragment ion are separated by more than their real mass separation; and assigning means for assigning a mass to the fragment ion using the mono-isotopic peak only.

25. A calibration apparatus according to claim 24, wherein the algorithm calculates that the isotopic peaks are separated by $(1+m_o)$ Daltons where $m_o$ is a parameter depending upon the mass spectrometer.

* * * * *